US007387074B2

(12) United States Patent
Myers

(10) Patent No.: US 7,387,074 B2
(45) Date of Patent: Jun. 17, 2008

(54) RAILWAY TRUCK BEARING ADAPTER

(75) Inventor: James C. Myers, Chesterfield, VA (US)

(73) Assignee: ASF-Keystone, Inc., Granite city, IL (US)

( * ) Notice: Subject to any disclaimer, the term of this patent is extended or adjusted under 35 U.S.C. 154(b) by 280 days.

(21) Appl. No.: 11/216,707

(22) Filed: Oct. 14, 2005

(65) Prior Publication Data

US 2007/0084377 A1 Apr. 19, 2007

(51) Int. Cl.
*B61F 15/00* (2006.01)

(52) U.S. Cl. ..... 105/224.1; 105/220

(58) Field of Classification Search ..... 105/218.1, 105/220, 224.1, 225

See application file for complete search history.

(56) References Cited

U.S. PATENT DOCUMENTS 3,381,629 A * 5/1968 Jones ..... 105/218.1
3,699,897 A * 10/1972 Sherrick ..... 105/218.1
3,785,298 A * 1/1974 Reynolds ..... 105/218.1
5,009,521 A * 4/1991 Wiebe ..... 105/224.1
5,081,935 A * 1/1992 Pavlick ..... 105/224.1
5,237,933 A * 8/1993 Bucksbee ..... 105/224.1
5,261,332 A * 11/1993 Grandy ..... 105/218.1
5,404,826 A * 4/1995 Rudibaugh et al. ..... 105/224.1
5,562,045 A * 10/1996 Rudibaugh et al. ..... 105/224.1

* cited by examiner

*Primary Examiner*—Lars A Olson
(74) *Attorney, Agent, or Firm*—Edward J. Brosius

(57) ABSTRACT

A railway car truck is provided that includes two sideframes and a bolster. Each sideframe has a pedestal opening at each end to receive a bearing adapter assembly. The bearing adapter assembly includes a cast steel bearing adapter that is formed to fit on top of a bearing assembly. An adapter pad, comprised of a selected hardness elastomer, is fit on top of the bearing adapter. The adapter pad may include a recess in a top section, with the recess extending the lateral width of the adapter pad. The pedestal opening may include a recess in the roof section, with the recess extending the lateral width of the pedestal opening.

15 Claims, 11 Drawing Sheets

RAILWAY TRUCK BEARING ADAPTER

BACKGROUND OF THE INVENTION

The present invention relates to a railway freight car truck and, more particularly, to an improved bearing adapter for use in the pedestal jaw opening of the sideframe of a railway freight car truck.

In a railway freight car truck, two axles are held in a pair of laterally spaced sideframes, with a bolster extending laterally between and supported on each sideframe. The wheels are press fit on the axles, with the ends of the axles also fitted with a roller bearing assembly. The roller bearing assembly itself is fit into a bearing adapter that is fit into a pedestal jaw opening at the longitudinal end of each sideframe. The ends of the bolsters are themselves supported on spring groups, which are supported on the lower portion of the center openings of the sideframes.

U.S. Pat. No. 5,562,045 discloses an adapter and pad assembly useful in the fitting of the bearing assembly into the pedestal jaw opening of each sideframe. The bearing adapter, which is itself fit on top of the bearing assembly, is comprised of a unitary cast steel piece. This piece includes shoulders that are laterally spaced to form a receiving opening at each longitudinal edge of the bearing adapter. An elastomeric adapter pad is fitted on top of the bearing adapter. The adapter pad itself is disclosed to be comprised of an injection molded polymer or a castable polyurethane. The adapter pad itself includes depending legs which extend from opposite longitudinal edges of the adapter pad. The depending legs are spaced laterally at each longitudinal edge of the adapter pad such that the depending legs are received in openings between the laterally spaced shoulders of the bearing adapter.

Accordingly, it is an object of the present invention to provide an improved bearing adapter and pad assembly for use in a railway truck sideframe pedestal opening.

SUMMARY OF THE INVENTION

A railway freight car truck of the so-called three piece standard design, is comprised of two laterally spaced, unitary cast steel sideframes and a laterally extending bolster, also of a unitary cast steel structure. The ends of the bolster are received and supported on spring groups that themselves are supported on the bottom section of a bolster opening in each sideframe.

The wheel axle assemblies themselves are received in openings, commonly referred to as pedestal jaw openings, at longitudinal ends of each sideframe. The wheel axle assemblies themselves extend laterally between the sideframes, and hence, also laterally between the two spaced railway tracks. For improved performance of the railway freight car truck, it is desirable to receive the bearings press fit on each axle end into a bearing adapter assembly.

In one embodiment, the improved bearing adapter assembly is comprised of a cast steel, unitary bearing adapter. This bearing adapter includes lateral edges themselves having arcuate cutouts to be placed over the bearing assembly. The bearing adapter further comprises depending shoulders that extend from each longitudinal edge of the bearing adapter. The shoulders at each longitudinal edge of the bearing adapter themselves are laterally spaced to form an opening there between. Further, the bearing adapter embodiment may include depressions that extend laterally and are spaced longitudinally across the top section of the bearing adapter. It should be understood that the top section of such bearing adapter is generally rectangular in structure, such that the depressions are near each longitudinal edge of the bearing adapter. These depressions can be of a general v-shape, formed by acute angle cuts into the top section of the bearing adapter, or they could be of an arcuate nature as well.

In one embodiment, the improved adapter pad is comprised of an improved elastomer or polymer, usually polyurethane. Such improved adapter pad is usually formed in a casting operation, although recent improvements have allowed the improved adapter pad to also be formed in an injection molding operation. The adapter pad itself is seen to be comprised of a generally rectangular top section, with depending legs extending from each longitudinal edge thereof. The depending legs are spaced laterally on each longitudinal edge. Such depending legs are fit downwardly into the opening in the bearing adapter and abut the shoulders of the bearing adapter to provide lateral support for the adapter pad. Further lateral support is provided by raised projections extending from the top of the bearing adapter that abut lateral edges of the adapter pad.

Further, the adapter pad may include laterally extending projections extending downwardly from the top section of the adapter pad. Such projections are received in the complementary depressions in the top section of the bearing adapter itself. These projections will correspond to the depressions in the bearing adapter, so it is seen that such projections may be of a general v-shape, formed by two wall sections extending downwardly at an acute angle from the lower surface of the top section. It is also seen that such projections could be of an arcuate nature, extending into complementary arcuate depressions in the top section of the bearing adapter.

The bearing adapter pad may include a recess extending laterally across the top surface of the pad. This recess may be generally rectangular in cross-section and extend across the lateral width of the bearing adapter pad.

The pedestal opening of the sideframe may include a recess extending laterally across the downwardly facing roof section of the pedestal opening. This recess may be generally rectangular in cross-section and extend across the lateral width of the pedestal opening.

The bearing adapter pad may include laterally extending projections extending upwardly into complementary depressions in the pedestal opening roof of the sideframe.

The bearing adapter pad may include a top surface that is concave when viewed in a lateral cross-section.

The bearing adapter pad may include a top surface that is depressed in an angled manner from each side edge toward the center when viewed in a lateral cross-section.

The bearing adapter pad may be comprised of two sections, each section extending from a side edge toward a lateral center line of the pedestal opening. A space is left laterally between each adapter pad section.

The bearing adapter pad may be comprised of two sections, each section extending from a side edge to a lateral center line of the pedestal opening.

The bearing adapter pad may include inserts near each lateral side; such inserts extending downwardly to form part or all of the depending legs of the bearing adapter pad. The inserts would be comprised of a higher durometer or stiffer material than the rest of the bearing adapter pad.

The bearing adapter pad may include laterally extending projections extending downwardly from the top section of the adapter pad; such projections would be relatively larger in cross-section than the complementary depressions in the top section of the bearing adapter. Such relative sizing would cause the majority of contact between the pedestal opening lower surface and the top of the bearing adapter pad to occur along lateral paths near the side edges of the bearing adapter pads.

DETAILED DESCRIPTION OF THE INVENTION

Figure 1:
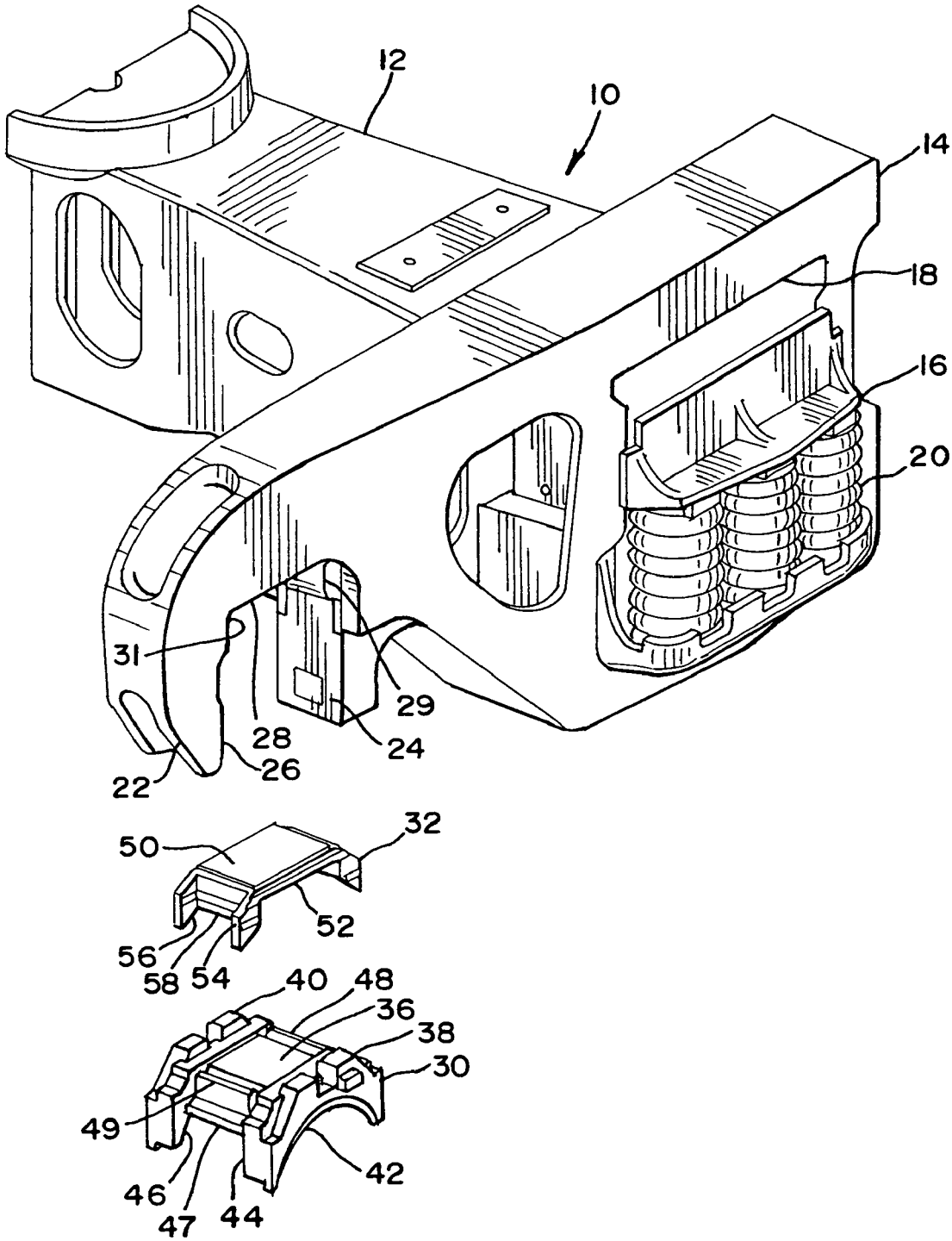
FIG. 1 is a partial perspective view of a sideframe and bolster and bearing adapter and adapter pad.

Referring now to FIG. 1 of the drawings, the lateral end of each sideframe 14 is seen to be comprised of a downwardly extending pedestal jaw 22. The inside wall 26 of pedestal jaw 22, along with roof section 28 and vertical face 24 are seen to combine to form the pedestal jaw opening. At the interface between vertical face 24 and roof section 28, there is seen to be an inner thrust lug 29. Inner thrust lug 29 is seen to comprise an angled section that extends from an upper section of vertical face 24 to an inward section of roof section 28. Similarly, but not entirely seen in this perspective view of FIG. 1, outer thrust lug 31 is seen to comprise an angled section extending from an upper portion of inside wall 26 extending to an inner portion of roof section 28.

Another part of the present invention includes bearing adapter 30, which is seen to be a generally rectangular structure having depending legs extending therefrom. Bearing adapter 30 is usually comprised of a unitary cast steel structure. Adapter pad 32 is also seen to be a generally rectangular structure with depending legs extending therefrom. Adapter pad 32 is usually comprised of a cast or injection molded polymer or elastomer, which will be further described.

Bearing adapter 30 is seen to be comprised of a unitary, cast steel structure that is generally rectangular in shape. Bearing adapter 30 is comprised of a generally rectangular top section 36, which is seen to be generally flat. Two raised edge supports 38 are seen to extend upwardly from the lateral edges of bearing adapter 30, as are similar raised edge supports 40 from the opposite lateral edge of bearing adapter 30. The combined raised edge supports 38 and 40 form a receiving surface and pocket for adapter pad 32. Bearing adapter 30 is also seen to comprise an arcuate opening 42 on each lower lateral edge; this arcuate opening 42 is adapted to seat against a bearing, which is not shown in this view. Bearing adapter 30 is also seen to comprise four depending shoulders, of which 44 and 46 are shown in this view. Depending shoulders 44 and 46 are seen to be laterally spaced, forming an opening for the adapter pad structure.

Adapter pad 32 is usually comprised of a cast polymer or elastomeric material and is of unitary structure. It is also possible to construct adapter pad 32 with a blown injection method, but casting is the preferred method of forming adapter pad 32. Adapter pad 32 is comprised of a generally rectangular and flat top section 50, with lateral edges, of which lateral edge 52 is shown. Four depending legs, of which depending leg 54 and 56 are shown in this view, are seen to extend downwardly, and form a thrust lug opening 58 there between. A similar thrust lug opening is formed on the other longitudinal edge of adapter pad 32. In assembling adapter pad 32 onto the top of bearing adapter 30, it can be seen that depending legs 54 and 56 project downwardly and are supported laterally against depending shoulders 44 and 46, respectively, of bearing adapter 30.

Referring now to FIG. 1, the partial perspective view of the main components of a railway freight car truck are shown generally at 10. Such components include bolster 12, which is generally a cast steel unitary structure, that extends laterally between two sideframes 14. Sideframes 14 are also unitary cast steel structures. Sideframes 14 are seen to extend longitudinally and parallel with the railway tracks. Each sideframe 14 includes a bolster opening 18 through which end 16 of bolster 12 extends. End 16 of bolster 12 is supported on spring group 20, with damping devices known as friction shoes, which are not shown in this view.

Figure 2:
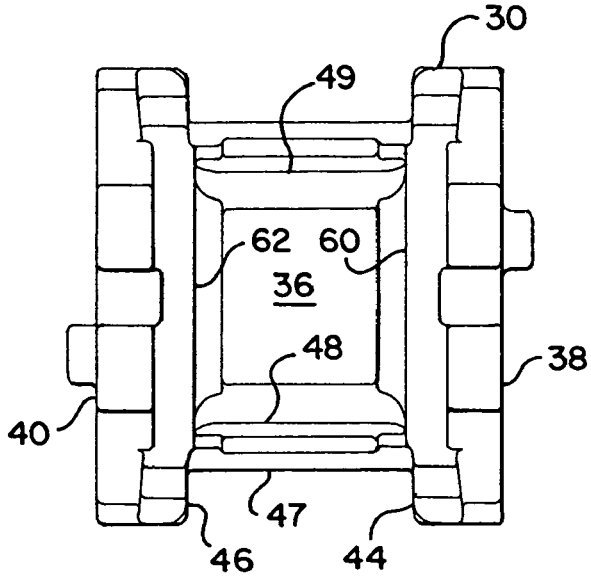
FIG. 2 is a top view of a first embodiment of a bearing adapter in accordance with the present invention.
Figure 3:
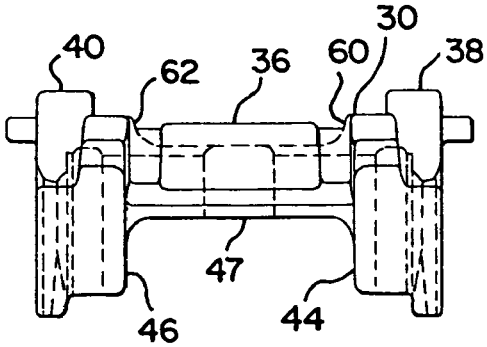
FIG. 3 is an end view of the first embodiment of a bearing adapter in accordance with the present invention.
Figure 4:
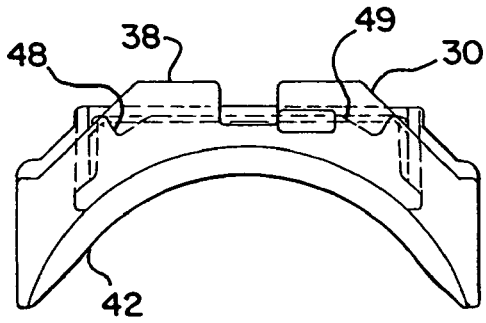
FIG. 4 is a side view of the first embodiment of a bearing adapter in accordance with the present invention.

Referring now to FIGS. 2-4, the detailed view of bearing adapter 30 shown in FIG. 1 is provided. This bearing adapter is used in a 6.5×12 size arrangement. Bearing adapter 30, as described above in FIG. 1, is seen to include a generally rectangular top section 36, with raised edge supports 38 and 40, extending upwardly from the lateral edges of bearing adapter 30. Arcuate opening 42 is also seen to be formed in lateral edges of bearing adapter 30 to allow fitting of bearing adapter 30 on top of a bearing assembly. Depending shoulders 44 and 46 are seen to extend downwardly from opposite longitudinal ends of bearing adapter 30, and depending shoulders 44 and 46 are seen to be spaced laterally from each other, forming opening 47. As shown in FIG. 1, and FIGS. 2 and 4, depressions 48 and 49 are spaced longitudinally and extend laterally across top section 36 of bearing adapter 30. Each of depressions 48 and 49 is seen to be comprised of a wall section extending downwardly from top section 36 at an acute angle therefrom. Depressions 48 and 49 are seen to extend across top section 36 to an intermediate support 60 and 62, respectively. Intermediate supports 60 and 62 are seen to extend longitudinally across top section 36 of bearing adapter 30, and are located inwardly from raised edge supports 38 and 40, respectively.

Figure 5:
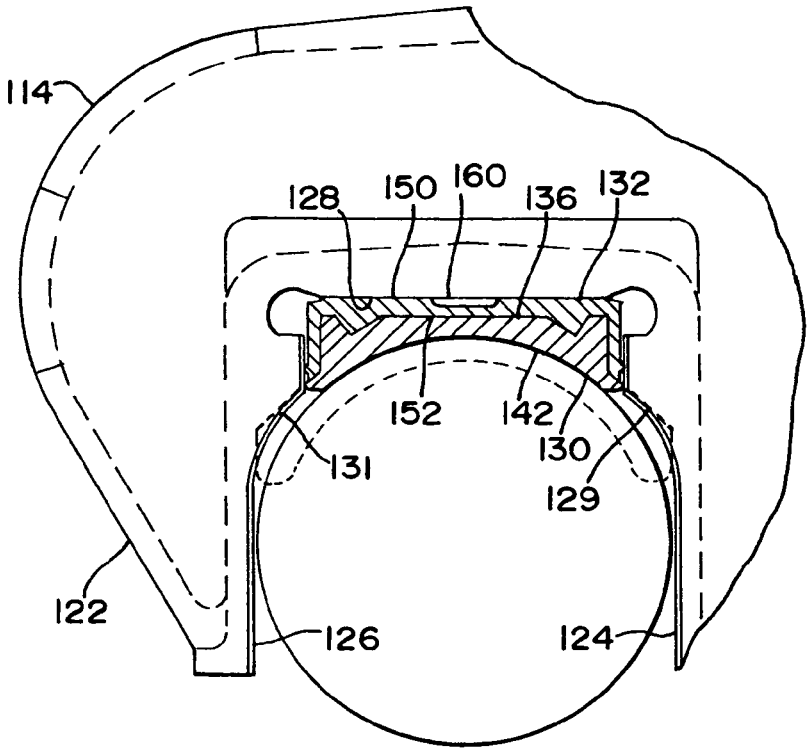
FIG. 5 is a front view impartial cross-section of a first embodiment of a bearing adapter pad and pedestal opening in accordance with the present invention.

Referring now to FIG. 5 of the drawings, the lateral end of each sideframe 114 is seen to be comprised of a downwardly extending pedestal jaw 122. The inside wall 126 of pedestal jaw 122, along with roof section 128 and vertical face 124 are seen to combine to form the pedestal jaw opening. At the interface between vertical face 124 and roof section 128, there is seen to be an inner thrust lug 129. Inner thrust lug 129 is seen to comprise an angled section that extends from an upper section of vertical face 124 to an inward section of roof section 128. Similarly, outer thrust lug 131 is seen to comprise an angled section extending from an upper portion of inside wall 126 extending to an inner portion of roof section 128.

Another part of the present invention includes bearing adapter 130, which is seen to be a generally rectangular structure having depending legs extending therefrom. Bearing adapter 130 is usually comprised of a unitary cast steel structure. Adapter pad 132 is also seen to be a generally rectangular structure with depending legs extending therefrom. Adapter pad 132 is usually comprised of a cast or injection molded polymer or elastomer, which will be further described.

Bearing adapter 130 is seen to be comprised of a unitary, cast steel structure that is generally rectangular in shape. Bearing adapter 130 is comprised of a generally rectangular top section 136, which is seen to be generally flat. Bearing adapter 130 is also seen to comprise an arcuate opening 142 on each lower lateral edge; this arcuate opening 142 is adapted to seat against a bearing, which is not shown in this view.

Adapter pad 132 is usually comprised of a cast polymer or elastomeric material and is of unitary structure. It is also possible to construct adapter pad 132 with a blown injection method, but casting is the preferred method of forming adapter pad 132. Adapter pad 132 is comprised of a generally rectangular and flat top section 150 with lateral edges.

A recess 160 is seen to be generally rectangular in cross-section and runs the lateral width of adapter pad 132 in the top section 150. Recess 160 is formed by side walls that are at an acute angle to top section 150 and a bottom section that is parallel to top section 150.

Figure 6:
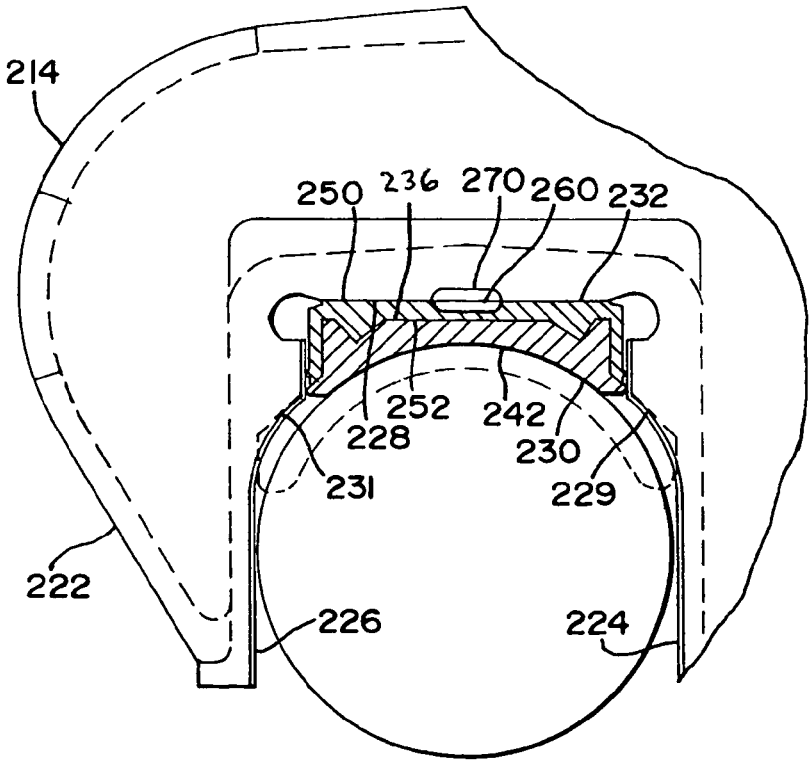
FIG. 6 is a front view of a second embodiment of a bearing adapter pad and pedestal opening in accordance with the present invention.

Referring now to FIG. 6 of the drawings, the lateral end of each sideframe 214 is seen to be comprised of a downwardly extending pedestal jaw 222. The inside wall 226 of pedestal jaw 222, along with roof section 228 and vertical face 224 are seen to comprise an angled section that extends from an upper section of vertical face 224 to an inward section of roof section 228. Similarly, outer thrust lug 231 is seen to comprise an angled section extending from an upper portion of inside wall 226 extending to an inner portion of roof section 228.

Another part of the present invention includes bearing adapter 230, which is seen to be a generally rectangular structure having depending legs extending therefrom. Bearing adapter 230 is usually comprised of a unitary cast steel structure. Adapter pad 232 is also seen to be a generally rectangular structure with depending legs extending therefrom. Adapter pad 232 is usually comprised of a cast or injection molded polymer or elastomer, which will be further described.

Bearing adapter 230 is seen to be comprised of a unitary, cast steel structure that is generally rectangular in shape. Bearing adapter 230 is comprised of a generally rectangular top section 236, which is seen to be generally flat. Bearing adapter 230 is also seen to comprise an arcuate opening 242 on each lower lateral edge; this arcuate opening 242 is adapted to seat against a bearing, which is not shown in this view.

Adapter pad 232 is usually comprised of a cast polymer or elastomeric material and is of unitary structure. It is also possible to construct adapter pad 232 with a blown injection method, but casting is the preferred method of forming adapter pad 232. Adapter pad 232 is comprised of a generally rectangular and flat top section 250 with lateral edges. A recess 260 is seen to be generally rectangular in cross-section and runs the lateral width in the top section 250. Recess 260 is formed by side walls that are at an acute angle to top section 250 and a bottom section that is parallel to top section 250.

A recess 270 is seen to be generally rectangular in cross-section and runs the lateral width in roof section 228. Recess 270 is formed by side walls that are at an acute angle to roof section 228 and a bottom section that is parallel to roof section 228.

Figure 7:
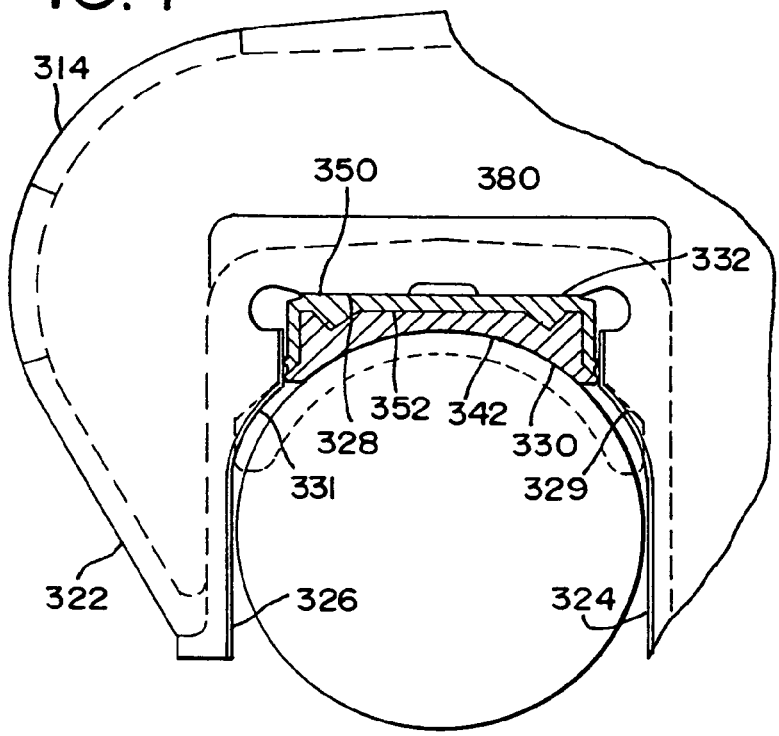
FIG. 7 is a front view of a third embodiment of a bearing adapter pad and pedestal opening in accordance with the present invention.

Referring now to FIG. 7 of the drawings, the lateral end of each sideframe 314 is seen to be comprised of a downwardly extending pedestal jaw 322. The inside wall 326 of pedestal jaw 322, along with roof section 328 and vertical face 324 are seen to combine to form the pedestal jaw opening. At the interface between vertical face 324 and roof section 328, there is seen to be an inner thrust lug 329. Inner thrust lug 329 is seen to comprise an angled section that extends from an upper section of vertical face 324 to an inward section of roof section 328. Similarly, outer thrust lug 331 is seen to comprise an angled section extending from an upper portion of inside wall 326 extending to an inner portion of roof section 328.

Another part of the present invention includes a bearing adapter 330, which is seen to be a generally rectangular structure having depending legs extending therefrom. Bearing adapter 330 is usually comprised of a unitary cast steel structure. Adapter pad 332 is also seen to be a generally rectangular structure with depending legs extending therefrom. Adapter pad 332 is usually comprised of a cast or injection molded polymer or elastomer, which will be further described.

Bearing adapter 330 is seen to be comprised of a unitary, cast steel structure that is generally rectangular in shape. Bearing adapter 330 is comprised of a generally rectangular top section 336, which is seen to be generally flat. Bearing adapter 330 is also seen to comprise an arcuate opening 342 on each lower lateral edge; this arcuate opening 342 is adapted to seat against a bearing, which is not shown in this view.

Adapter pad 332 is usually comprised of a cast polymer or elastomeric material and is of unitary structure. It is also possible to construct adapter pad 332 with a blown injection method, but casting is the preferred method of forming adapter pad 332. Adapter pad 332 is comprised of a generally rectangular and flat top section 350 with lateral edges. A recess 380 is seen to be generally rectangular in cross-section and runs the lateral width in roof section 328. Recess 380 is formed by side walls that are at an acute angle to roof section 328 and a bottom section that is parallel to roof section 328.

Figure 8:
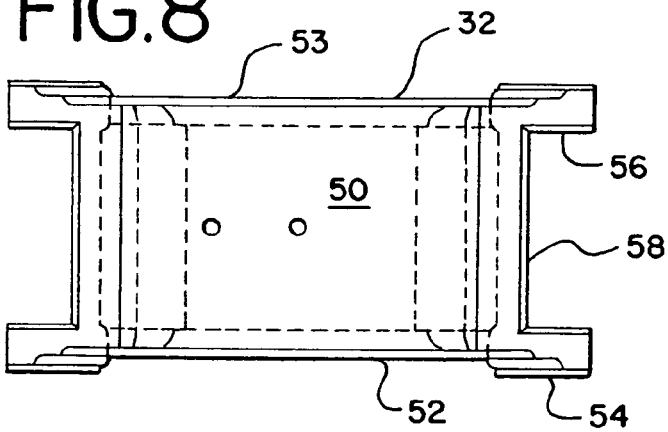
FIG. 8 is a top view of an adapter pad in accordance with the present invention.
Figure 10:
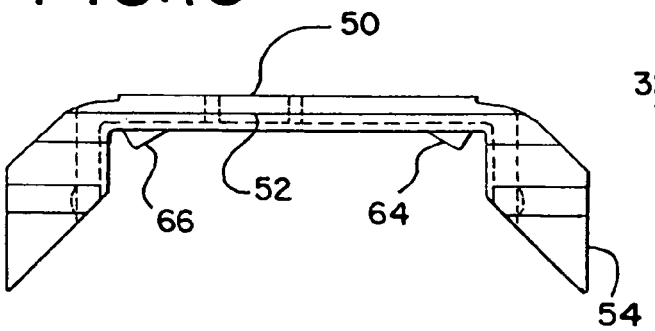
FIG. 10 is a side view of an adapter pad in accordance with the present invention.
Figure 9:
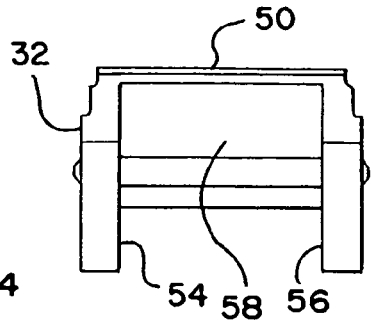
FIG. 9 is an end view of an adapter pad in accordance with the present invention.

Referring now to FIGS. 8-10, a detailed view of adapter pad 32 is provided. Adapter pad 32 is seen to be comprised of a generally rectangular top section 50. Top section 50 includes lateral edges 52 and 53. Legs 54 and 56, extend downwardly from each longitudinal edge of adapter pad 32. Legs 54 and 56 are seen to be spaced laterally so as to form thrust lug opening 58 there between. Thrust lug opening 58 and its counterpart at the other longitudinal edge of adapter pad 32 is seen to receive one of inner thrust lug 29 or outer thrust lug 31, when adapter pad 32 is fit up into roof section 28 of pedestal jaw 22.

Bearing adapter pad 32 is also seen to comprise depending protrusions 64 and 66, that extend downwardly from the bottom surface of top section 50. Protrusions 64 and 66 are seen to extend laterally across the width of adapter pad 32, extending to, or nearly to, lateral edges 52 and 53. Protrusions 64 and 66 are designed to be fit into depressions 48 and 49 in top section 36 of bearing adapter 30. Such fitting provides lateral and longitudinal stability for adapter pad 32 when fit against bearing adapter 30. Lateral stability is also provided with edges 52 and 53 of adapter pad 32 abutting raised edge supports 38 and 40, respectively, of bearing adapter 30.

Adapter pad 32 is comprised of a cast elastomer of a durometer hardness between 90A and 58D. It should be understood that it is preferred to have adapter pad 32 formed in a casting operation to obtain the desired hardness ratings, but other forming operations are possible so long as the preferred hardness ratings of adapter pad 32 are provided.

Figure 11:
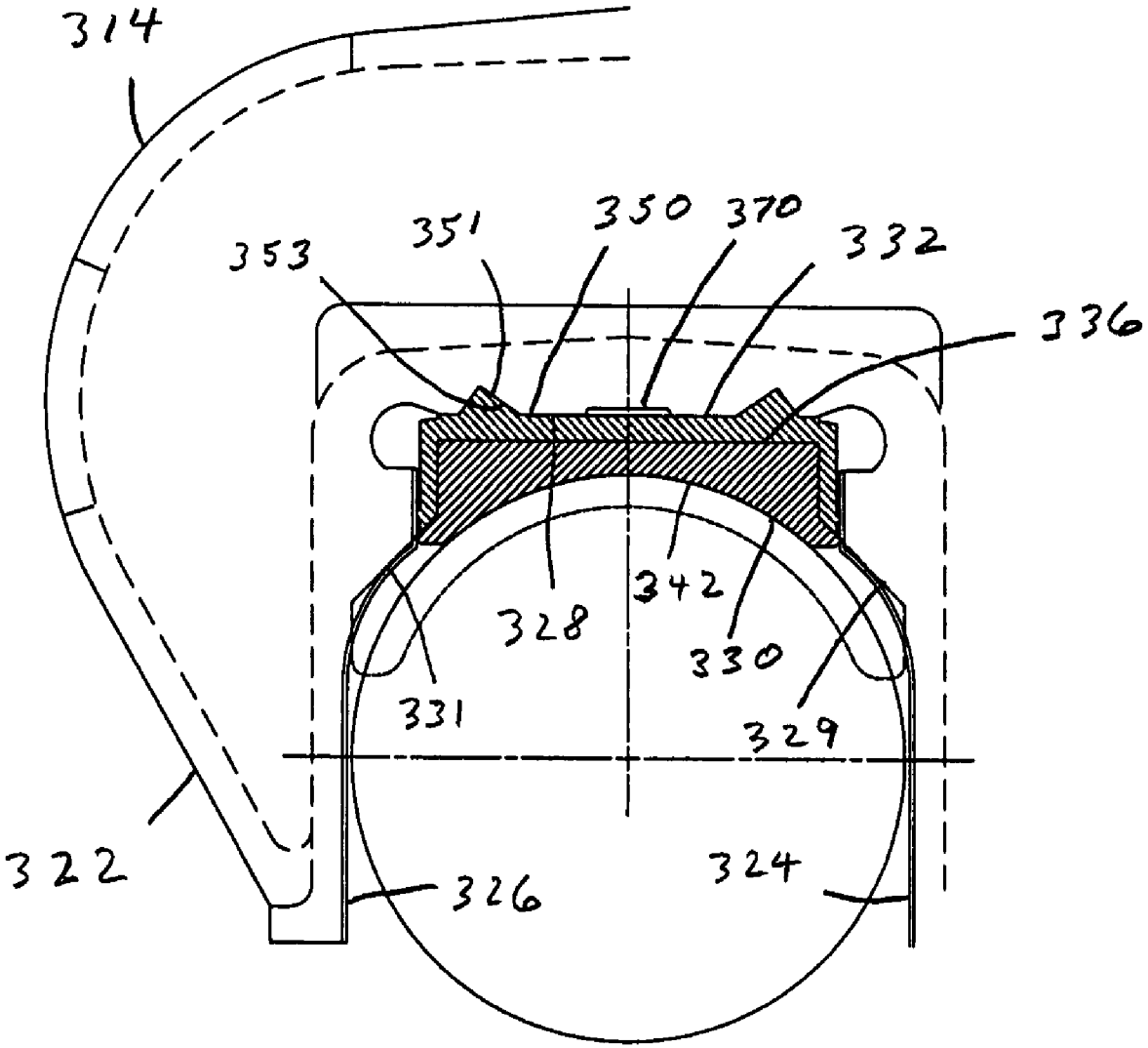
FIG. 11 is a front view of a fourth embodiment of a bearing adapter pad and pedestal opening in accordance with the present invention.

Referring now to FIG. 11 of the drawings, the lateral end of each sideframe 314 is seen to be comprised of a downwardly extending pedestal jaw 322. The inside wall 326 of pedestal jaw 322, along with roof section 328 and vertical face 324 are seen to comprise an angled section 329 that extends from an upper section of vertical face 324 to an inward section of roof section 328. Similarly, outer thrust lug 331 is seen to comprise an angled section extending from an upper portion of inside wall 326 extending to an inner portion of roof section 328.

Another part of the present invention includes bearing adapter 330, which is seen to be a generally rectangular structure having depending legs extending therefrom. Bearing adapter 330 is usually comprised of a unitary cast steel structure. Adapter pad 332 is also seen to be a generally rectangular structure with depending legs extending therefrom. Adapter pad 332 is usually comprised of a cast or injection molded polymer or elastomer, which will be further described.

Bearing adapter 330 is seen to be comprised of a unitary, cast steel structure that is generally rectangular in shape. Bearing adapter 330 is comprised of a generally rectangular top section 336, which is seen to be generally flat. Bearing adapter 330 is also seen to comprise an arcuate opening 342 on each lower lateral edge; this arcuate opening 342 is adapted to seat against a bearing, which is not shown in this view.

Adapter pad 332 is usually comprised of a cast polymer or elastomeric material and is of unitary structure. It is also possible to construct adapter pad 332 with a blown injection method, but casting is the preferred method of forming adapter pad 332. Adapter pad 332 is comprised of a generally rectangular and flat top section 350 with lateral edges. Adapter pad 332 also includes laterally extending projections 351 that are received in complementary recesses 353 in the roof of the pedestal of sideframe 314.

A recess 370 is seen to be generally rectangular in cross-section and runs the lateral width in roof section 328. Recess 370 is formed by side walls that are at an acute angle to roof section 328 and a bottom section that is parallel to roof section 328.

Figure 12:
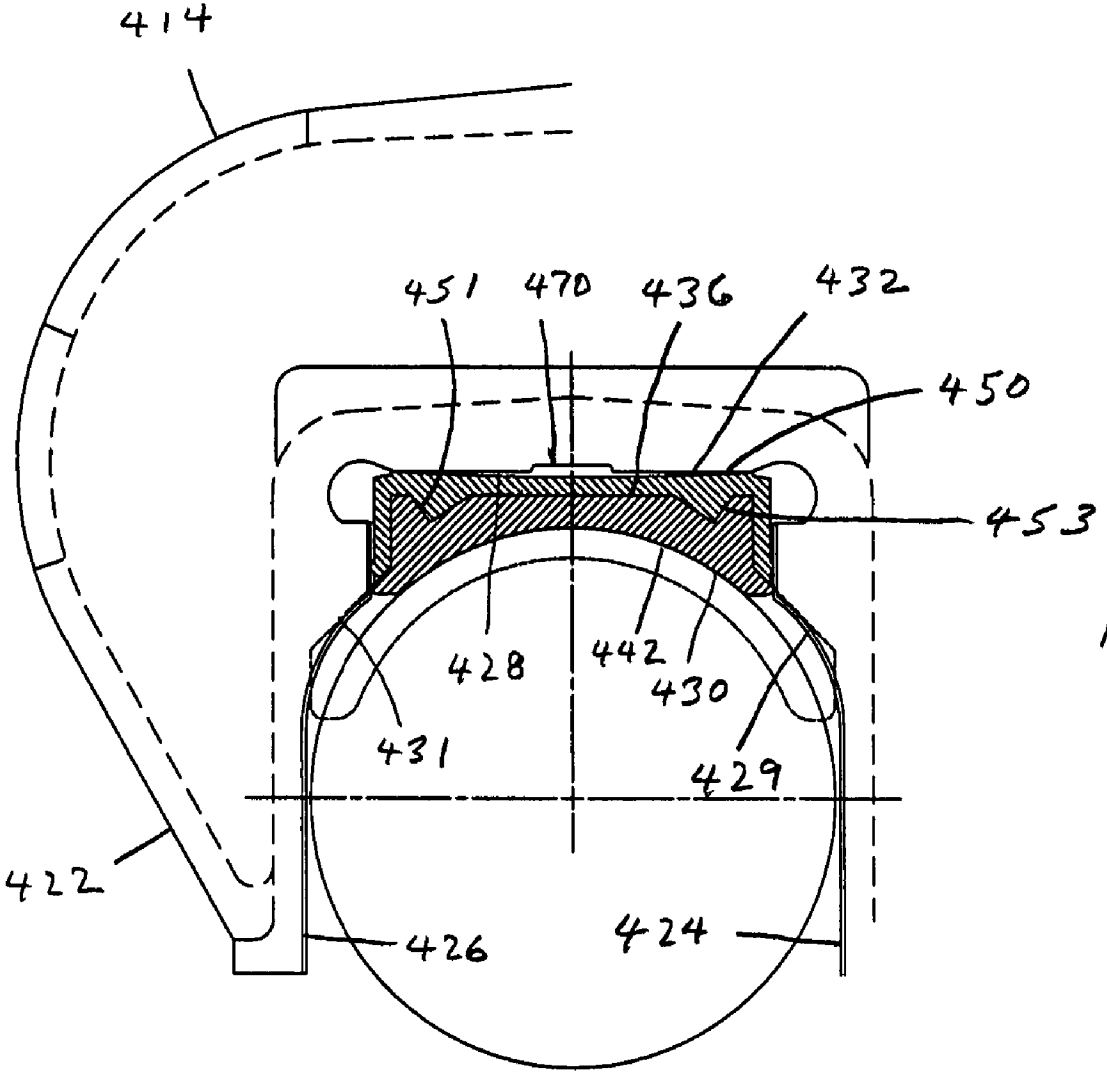
FIG. 12 is a front view of a fifth embodiment of a bearing adapter pad and pedestal opening in accordance with the present invention.

Referring now to FIG. 12 of the drawings, the lateral end of each sideframe 414 is seen to be comprised of a downwardly extending pedestal jaw 422. The inside wall 426 of pedestal jaw 422, along with roof section 428 and vertical face 424 are seen to comprise an angled section 429 that extends from an upper section of vertical face 424 to an inward section of roof section 428. Similarly, outer thrust lug 431 is seen to comprise an angled section extending from an upper portion of inside wall 426 extending to an inner portion of roof section 428.

Another part of the present invention includes bearing adapter 430, which is seen to be a generally rectangular structure having depending legs extending therefrom. Bearing adapter 430 is usually comprised of a unitary cast steel structure. Adapter pad 432 is also seen to be a generally rectangular structure with depending legs extending therefrom. Adapter pad 432 is usually comprised of a cast or injection molded polymer or elastomer, which will be further described.

Bearing adapter 430 is seen to be comprised of a unitary, cast steel structure that is generally rectangular in shape. Bearing adapter 430 is comprised of a generally rectangular top section 436, which is seen to be generally flat. Bearing adapter 430 is also seen to comprise an arcuate opening 442 on each lower lateral edge; this arcuate opening 442 is adapted to seat against a bearing, which is not shown in this view.

Adapter pad 432 is usually comprised of a cast polymer or elastomeric material and is of unitary structure. It is also possible to construct adapter pad 432 with a blown injection method, but casting is the preferred method of forming adapter pad 432. Adapter pad 432 is comprised of a generally concave along a lateral cross-section top section 450. Such a concave top section causes contact between pedestal roof 428 and the lateral edges of top section 450 of adapter pad 432. Adapter pad 432 also includes laterally extending projections 453 that are received in complementary recesses 451 in the top section 436 of bearing adapter 430.

A recess 470 is seen to be generally rectangular in cross-section and runs the lateral width in roof section 428. Recess 470 is formed by side walls that are at an acute angle to roof section 328 and a bottom section that is parallel to roof section 428.

Figure 13:
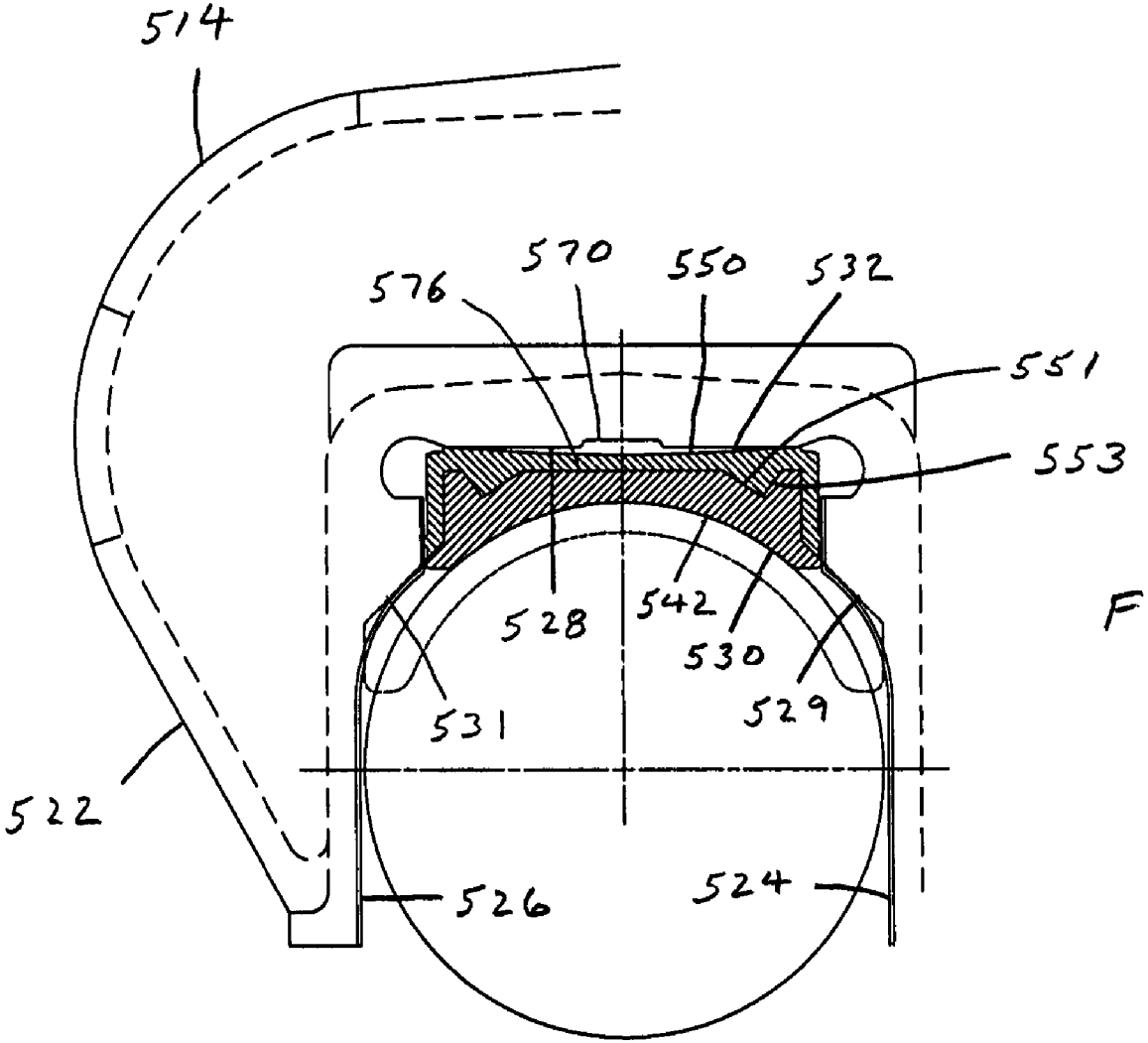
FIG. 13 is a front view of a sixth embodiment of a bearing adapter pad and pedestal opening in accordance with the present invention.

Referring now to FIG. 13 of the drawings, the lateral end of each sideframe 514 is seen to be comprised of a downwardly extending pedestal jaw 522. The inside wall 526 of pedestal jaw 522, along with roof section 528 and vertical face 524 are seen to comprise an angled section 529 that extends from an upper section of vertical face 524 to an inward section of roof section 528. Similarly, outer thrust lug 531 is seen to comprise an angled section extending from an upper portion of inside wall 526 extending to an inner portion of roof section 528.

Another part of the present invention includes bearing adapter 530, which is seen to be a generally rectangular structure having depending legs extending therefrom. Bearing adapter 530 is usually comprised of a unitary cast steel structure. Adapter pad 532 is also seen to be a generally rectangular structure with depending legs extending therefrom. Adapter pad 532 is usually comprised of a cast or injection molded polymer or elastomer, which will be further described.

Bearing adapter 530 is seen to be comprised of a unitary, cast steel structure that is generally rectangular in shape. Bearing adapter 530 is comprised of a generally rectangular top section 536, which is seen to be generally flat. Bearing adapter 530 is also seen to comprise an arcuate opening 542 on each lower lateral edge; this arcuate opening 542 is adapted to seat against a bearing, which is not shown in this view.

Adapter pad 532 is usually comprised of a cast polymer or elastomeric material and is of unitary structure. It is also possible to construct adapter pad 532 with a blown injection method, but casting is the preferred method of forming adapter pad 532. Adapter pad 532 is comprised of a compound aligned, generally concave along a lateral cross-section top section 550 such a compound angled, generally concave top section 550 causes contact between pedestal roof 528 and the lateral edge of top section 550 of adapter pad 532. Adapter pad 532 also includes laterally extending projections 553 that are received in complementary recesses 551 in the top section 576 of bearing adapter 530.

A recess 570 is seen to be generally rectangular in cross-section and runs the lateral width in roof section 528. Recess 570 is formed by side walls that are at an acute angle to roof section and a bottom section that is parallel to roof section 528.

Figure 14:
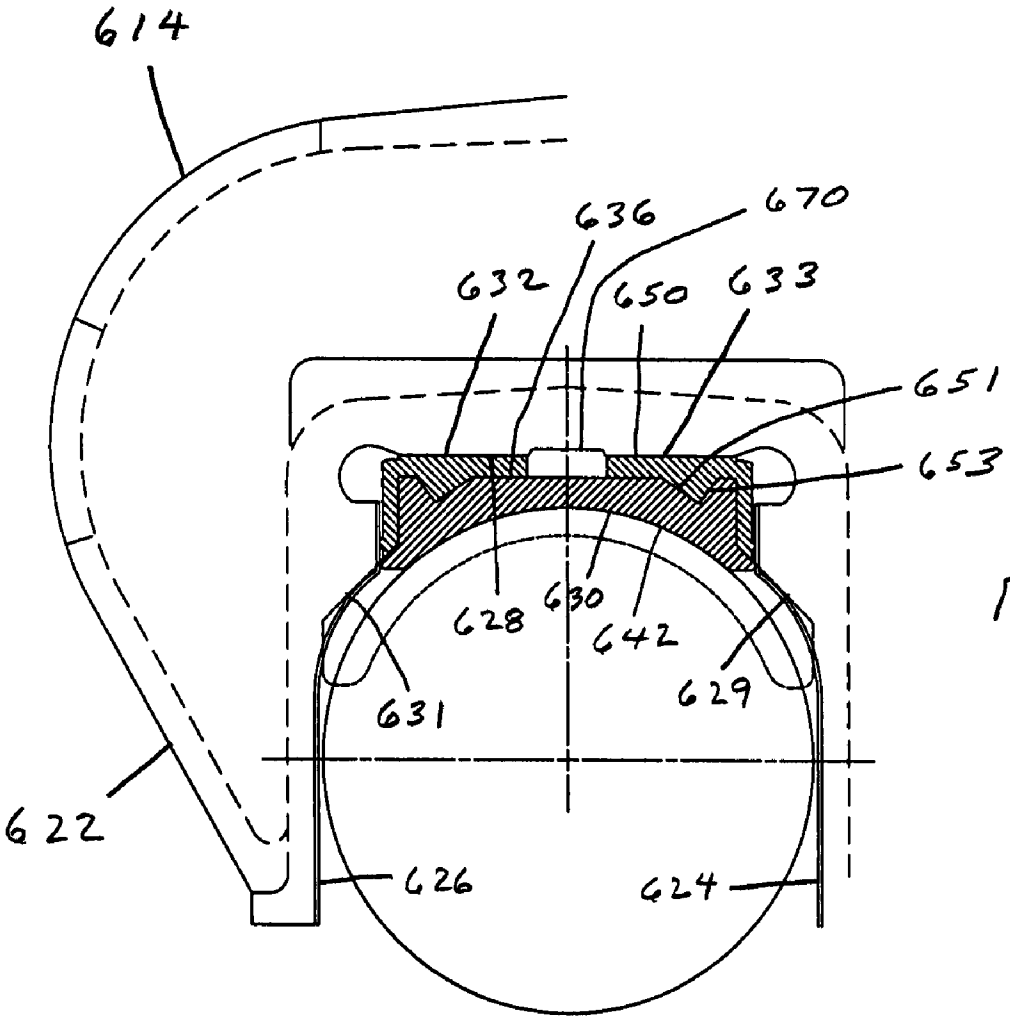
FIG. 14 is a front view of a seventh embodiment of a bearing adapter pad and pedestal opening in accordance with the present invention.

Referring now to FIG. 14 of the drawings, the lateral end of each sideframe 614 is seen to be comprised of a downwardly extending pedestal jaw 622. The inside wall 626 of pedestal jaw 622, along with roof section 628 and vertical face 624 are seen to comprise an angled section 629 that extends from an upper section of vertical face 624 to an inward section of roof section 628. Similarly, outer thrust lug 631 is seen to comprise an angled section extending from an upper portion of inside wall 626 extending to an inner portion of roof section 628.

Another part of the present invention includes bearing adapter 630, which is seen to be a generally rectangular structure having depending legs extending therefrom. Bearing adapter 630 is usually comprised of a unitary cast steel structure. Adapter pads 632 and 633 are also seen to be a generally rectangular structures with depending legs extending therefrom. Adapter pads 632 and 633 are usually comprised of a cast or injection molded polymer or elastomer, which will be further described.

Bearing adapter 630 is seen to be comprised of a unitary, cast steel structure that is generally rectangular in shape. Bearing adapter 630 is comprised of a generally rectangular top section 636, which is seen to be generally flat. Bearing adapter 630 is also seen to comprise an arcuate opening 642 on each lower lateral edge; this arcuate opening 642 is adapted to seat against a bearing, which is not shown in this view.

Adapter pads 632 and 633 are usually comprised of a cast polymer or elastomeric material and are each of a unitary structure. It is also possible to construct adapter pad 632 or 633 with a blown injection method, but casting is the preferred method of forming adapter pad 632 or 633. Adapter pad 632 and 633 are each comprised of a generally rectangular and flat top section 650 with lateral edges. Each adapter pad 632 and 633 also includes a laterally extending projection 653 that is received in a complementary recess 651 in the top section 636 of bearing adapter 630.

A recess 670 is seen to be generally rectangular in cross-section and runs the lateral width in roof section 628. Recess 670 is formed by side walls that are at an acute angle to roof section 628 and a bottom section that is parallel to roof section 628. Each adapter pad 632 and 633 is located adjacent or to either side of recess 670.

Figure 15:
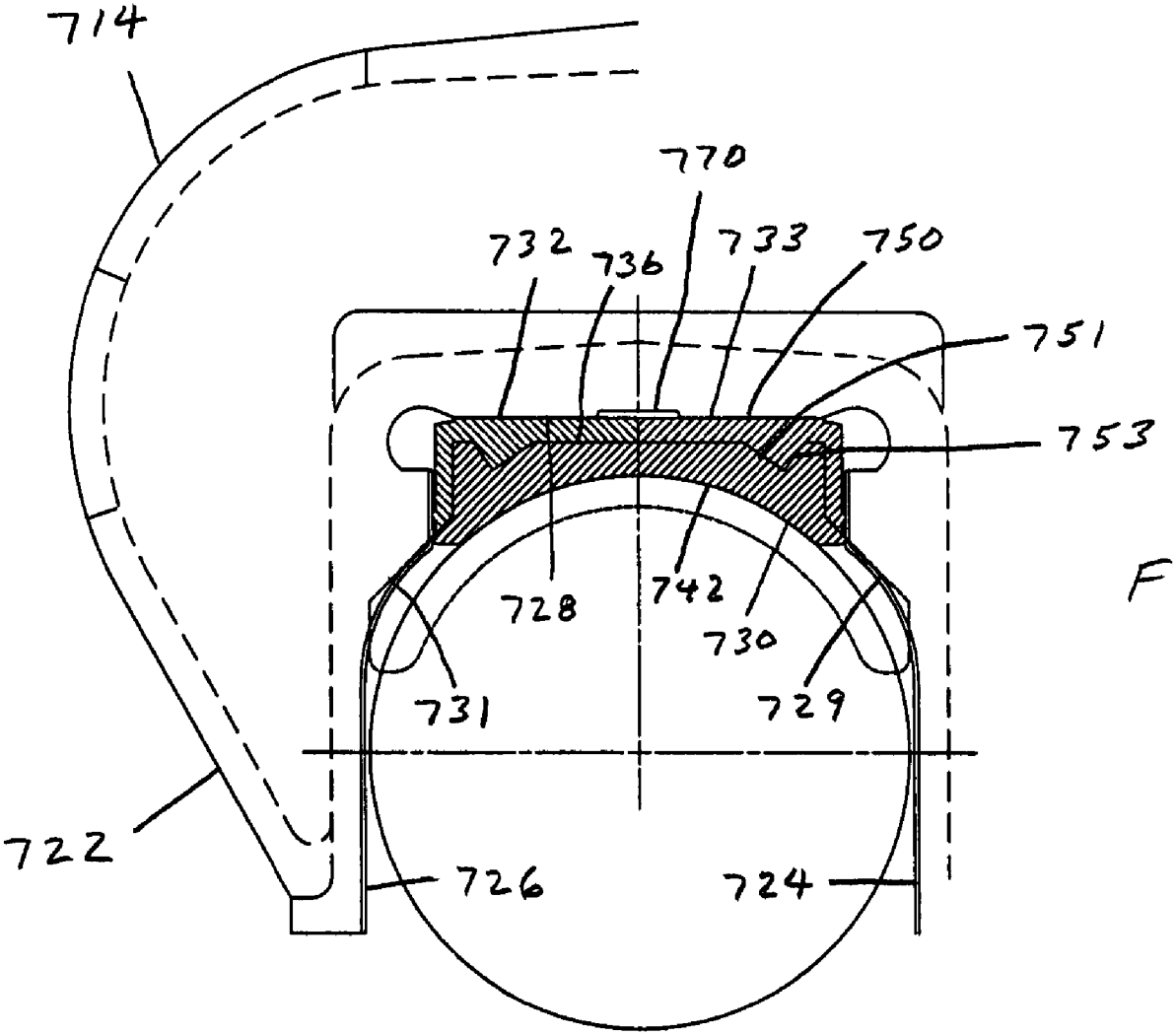
FIG. 15 is the front view of an eighth embodiment of a bearing adapter pad and pedestal opening in accordance with the present invention.

Referring now to FIG. 15 of the drawings, the lateral end of each sideframe 714 is seen to be comprised of a downwardly extending pedestal jaw 722. The inside wall 726 of pedestal jaw 722, along with roof section 728 and vertical face 724 are seen to comprise an angled section 729 that extends from an upper section of vertical face 724 to an inward section of roof section 728. Similarly, outer thrust lug 731 is seen to comprise an angled section extending from an upper portion of inside wall 726 extending to an inner portion of roof section 728. Another part of the present invention includes bearing adapter 730, which is seen to be a generally rectangular structure having depending legs extending therefrom. Bearing adapter 730 is usually comprised of a unitary cast steel structure. Adapter pads 732 and 733 are also seen to be generally rectangular structures with depending legs extending therefrom. Adapter pad 732 and 733 are usually comprised of a cast or injection molded polymer or elastomer, which will be further described.

Bearing adapter 730 is seen to be comprised of a unitary, cast steel structure that is generally rectangular in shape. Bearing adapter 730 is comprised of a generally rectangular top section 736, which is seen to be generally flat. Bearing adapter 730 is also seen to comprise an arcuate opening 742 on each lower lateral edge; this arcuate opening 742 is adapted to seat against a bearing, which is not shown in this view.

Adapter pads 732 and 733 are usually comprised of a cast polymer or elastomeric material and are each of a unitary structure. It is also possible to construct adapter pad 732 or 733 with a blown injection method, but casting is the preferred method of forming adapter pad 732. Adapter pad 732 and 733 are each comprised of a generally rectangular and flat top section 750 with lateral edges. Each adapter pad 732 and 733 also includes a laterally extending projection 753 that is received in a complementary recess 751 in the top section 736 of bearing adapter 730.

A recess 770 is seen to be generally rectangular in cross-section and runs the lateral width in roof section 728. Recess 770 is formed by side walls that are at an acute angle to roof section 728 and a bottom section that is parallel to roof section 728. Each adapter pad 732 and 733 are seen to have lateral edges that approach each other or meet between recess 770.

Figure 16:
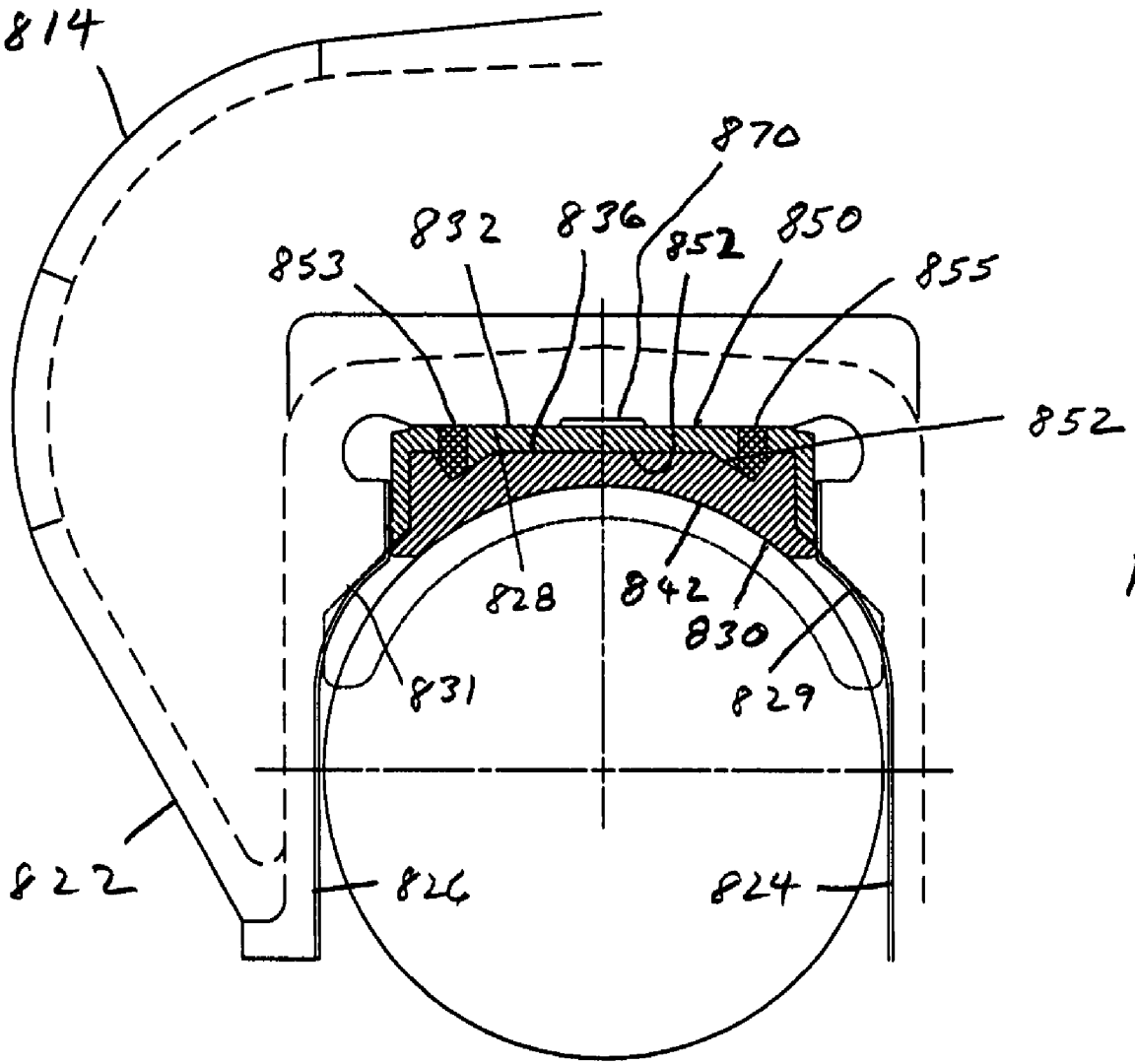
FIG. 16 is a front view of a ninth embodiment of a bearing adapter pad and pedestal opening in accordance with the present invention.

Referring now to FIG. 16 of the drawings, the lateral end of each sideframe 814 is seen to be comprised of a downwardly extending pedestal jaw 822. The inside wall 826 of pedestal jaw 822, along with roof section 828 and vertical face 824 are seen to comprise an angled section 829 that extends from an upper section of vertical face 824 to an inward section of roof section 828. Similarly, outer thrust lug 831 is seen to comprise an angled section extending from an upper portion of inside wall 826 extending to an inner portion of roof section 828.

Another part of the present invention includes bearing adapter 830, which is seen to be a generally rectangular structure having depending legs extending therefrom. Bearing adapter 830 is usually comprised of a unitary cast steel structure. Adapter pad 832 is also seen to be a generally rectangular structure with depending legs extending therefrom. Adapter pad 832 is usually comprised of a cast or injection molded polymer or elastomer, which will be further described.

Bearing adapter 830 is seen to be comprised of a unitary, cast steel structure that is generally rectangular in shape. Bearing adapter 830 is comprised of a generally rectangular top section 836, which is seen to be generally flat. Bearing adapter 830 is also seen to comprise an arcuate opening 842 on each lower lateral edge; this arcuate opening 842 is adapted to seat against a bearing, which is not shown in this view.

Adapter pad 832 is usually comprised of a cast polymer or elastomeric material and is of unitary structure. It is also possible to construct adapter pad 832 with a blown injection method, but casting is the preferred method of forming adapter pad 832. Adapter pad 832 is comprised of a generally rectangular and flat top section 850 with lateral edges. Inserts 853 and 855 are seen to be generally five sided in cross-section and runs the lateral width in adapter pad 832. Inserts 853 and 855 have a bottom section that projects from the bottom surface 852 of adapter pad 832 and is each received in a complementary recess 851 in the top section 836 of bearing adapter 830. Inserts 853 and 855 are comprised of a polymer or an elastomer of a higher durometer hardness or stiffener than of adapter pad 832. Such properties of inserts 853 and 855 cause contact between pedestal roof 828 and the lateral edges of top section 850 of adapter pad 832.

A recess 870 is seen to be generally rectangular in cross-section and runs the lateral width in roof section 828. Recess 870 is formed by side walls that are at an acute angle to roof section 828 and a bottom section that is parallel to roof section 828.

Figure 17:
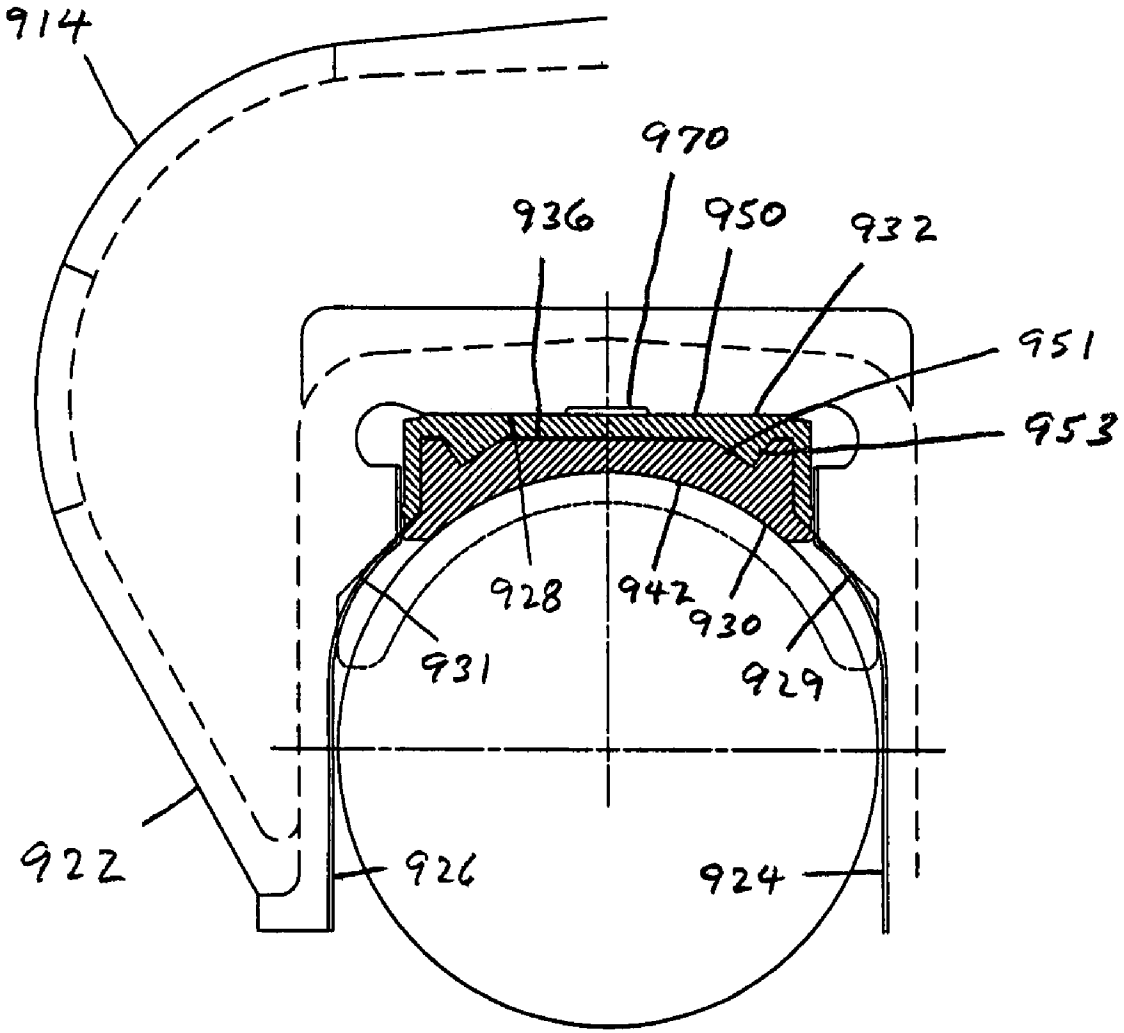
FIG. 17 is a front view of a tenth embodiment of a bearing adapter pad and pedestal opening in accordance with the present invention.

Referring now to FIG. 17 of the drawings, the lateral end of each sideframe 914 is seen to be comprised of a downwardly extending pedestal jaw 922. The inside wall 926 of pedestal jaw 922, along with roof section 928 and vertical face 924 are seen to comprise an angled section 929 that extends from an upper section of vertical face 924 to an inward section of roof section 928. Similarly, outer thrust lug 931 is seen to comprise an angled section extending from an upper portion of inside wall 926 extending to an inner portion of roof section 928.

Another part of the present invention includes bearing adapter 930, which is seen to be a generally rectangular structure having depending legs extending therefrom. Bearing adapter 930 is usually comprised of a unitary cast steel structure. Adapter pad 932 is also seen to be a generally rectangular structure with depending legs extending therefrom. Adapter pad 932 is usually comprised of a cast or injection molded polymer or elastomer, which will be further described.

Bearing adapter 930 is seen to be comprised of a unitary, cast steel structure that is generally rectangular in shape. Bearing adapter 930 is comprised of a generally rectangular top section 936, which is seen to be generally flat. Bearing adapter 930 is also seen to comprise an arcuate opening 942 on each lower lateral edge; this arcuate opening 942 is adapted to seat against a bearing, which is not shown in this view.

Adapter pad 932 is usually comprised of a cast polymer or elastomeric material and is of unitary structure. It is also possible to construct adapter pad 932 with a blown injection method, but casting is the preferred method of forming adapter pad 932. Adapter pad 932 is comprised of a generally rectangular and flat top section 950 with lateral edges. Adapter pad 932 also includes laterally extending projections 953 that are larger in cross-sectional area than complementarily shaped recesses 951 in the top section 936 of bearing adapter 930. Accordingly, contact between pedestal roof 928 and the lateral edges of top section 950 of adapter pad 932 is caused.

A recess 970 is seen to be generally rectangular in cross-section and runs the lateral width in roof section 928. Recess 970 is formed by side walls that are at an acute angle to roof section 928 and a bottom section that is parallel to roof section 928.

What is claimed is:

1. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein the pedestal opening includes a recess in the roof section extending the lateral width of the roof section of the pedestal opening;

and wherein the adapter pad includes two laterally extending projections that extend upwardly, and the pedestal opening includes two complementary depressions to receive the laterally extending projections on the adapter pad.

2. The railway car truck of claim 1 wherein the adapter pad is comprised of an elastomer polymer blend.

3. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad mounted on top of the bearing adapter, the elastomeric adapter pad comprising a slightly concave in a lateral cross-section, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein the adapter pad includes two laterally extending projections that extend downwardly, and the bearing adapter includes two complementary depressions to receive the laterally extending projections on the adapter pad.

4. The railway car truck of claim 3 wherein the adapter pad is comprised of an elastomer polymer blend.

5. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad mounted on top of the bearing adapter, the elastomeric adapter pad comprising a compound angled, slightly concave in lateral cross-section, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein the adapter pad includes two laterally extending projections that extend downwardly, and the bearing adapter includes two complementary depressions to receive the laterally extending projections on the adapter pad.

6. The railway car truck of claim 5 wherein the adapter pad is comprised of an elastomer polymer blend.

7. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad comprising two separate sections mounted on top of the bearing adapter, each elastomeric adapter pad section comprising a generally flat, generally rectangular top section that extends the lateral width of the adapter pad section, the adapter pad sections being longitudinals spaced from each other, and a depending leg that extend downwardly from each longitudinal end of each adapter pad section, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each adapter pad section includes a laterally extending projection that extends downwardly, and the bearing adapter includes two complementary depressions each receiving one of the laterally extending projections on each adapter pad section.

8. The railway car truck of claim 7 wherein the adapter pad is comprised of an elastomer polymer blend.

9. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad comprising two separate sections mounted on top of the bearing adapter, each elastomeric adapter pad section comprising a generally flat, generally rectangular top section that extends the lateral width of the adapter pad section, the adapter sections being adjacent to each other and a depending leg that extend downwardly from each longitudinal end of each adapter pad section, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein each adapter pad section includes a laterally extending projection that extends downwardly, and the bearing adapter includes two complementary depressions each receiving one of the laterally extending projections on each adapter pad section.

10. The railway car truck of claim 9 wherein the adapter pad is comprised of an elastomer polymer blend.

11. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an adapter pad mounted on top of the bearing adapter, the elastomeric adapter pad comprising a generally flat, generally rectangular top section that extends the lateral width of the adapter pad, the adapter pad also includes inserts near each lateral side, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein the adapter pad includes two laterally extending projections that extend downwardly with each insert comprising a substantial portion of each projection, and the bearing adapter includes two complementary depressions each receiving one of the laterally extending projection on the adapter pad.

12. The railway car truck of claim 11 wherein the adapter pad is comprised of an elastomer polymer blend.

13. The railway car truck of claim 11 wherein the adapter pad insert is comprised of an elastomer blend and has a durometer hardness greater than the durometer hardness of the adapter pad itself.

14. A railway car truck comprising two sideframes and a bolster, each sideframe having a pedestal opening at each end, each pedestal opening formed by a laterally outboard pedestal jaw, a laterally inboard vertical face and a roof section extending between the pedestal jaw and the vertical face, a first thrust lug extending at the junction of the laterally inboard vertical face and the roof section, and a second thrust lug extending at the junction of the vertical face and the roof section, a bearing adapter received in each pedestal opening, each bearing adapter comprising a generally rectangular center section having a top surface, a concave opening in opposite lateral end sections to receive a bearing, each bearing adapter having a generally rectangular opening at opposite ends of the longitudinal end sections, each opening formed by a laterally extending adapter wall end and two laterally spaced, depending adapter shoulders, an elastomeric adapter pad mounted on top of the bearing adapter, the elastomeric adapter pad comprising a generally flat, generally rectangular top section that extends the lateral width of the adapter pad, and two pair of depending legs that extend downwardly from each longitudinal end of the adapter pad, the adapter pad legs being spaced laterally to form a thrust lug opening at each longitudinal end of the adapter pad, a thrust lug of each sideframe pedestal opening received in the thrust lug opening of the adapter pad, the pair of adapter pad legs at each longitudinal end of the adapter pad received in the generally rectangular opening at each longitudinal end of the bearing adapter, and wherein the adapter pad includes two laterally extending projections that extend downwardly, and the bearing adapter includes two complementary depressions each receiving one of the laterally extending projections on the adapter pad, and where the cross-sectional area of each adapter pad projection is greater than the cross-sectional area of each depression in the bearing adapter.

15. The railway car truck of claim 14 wherein the adapter pad is comprised of an elastomer blend.

* * * * *